US006536413B2

(12) United States Patent
Mori

(10) Patent No.: US 6,536,413 B2
(45) Date of Patent: Mar. 25, 2003

(54) ACCUMULATOR FUEL INJECTION APPARATUS FOR INTERNAL COMBUSTION ENGINES

(75) Inventor: Katsumi Mori, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/888,537

(22) Filed: Jun. 26, 2001

(65) Prior Publication Data

US 2002/0014221 A1 Feb. 7, 2002

(30) Foreign Application Priority Data

Jul. 21, 2000 (JP) ..... 2000-220129

(51) Int. Cl.[7] ..... F02M 37/04
(52) U.S. Cl. ..... 123/467; 123/506; 137/514.5
(58) Field of Search ..... 123/506, 446–447, 123/457, 514, 467; 137/514.5

(56) References Cited

U.S. PATENT DOCUMENTS 3,029,834 A * 4/1962 Hoek ..... 137/514.5
4,648,369 A * 3/1987 Wannenwetsch ..... 123/467
5,033,506 A * 7/1991 Bofinger et al. ..... 123/467
5,183,075 A * 2/1993 Stein ..... 137/514.5
5,295,469 A 3/1994 Kariya et al. ..... 123/456
5,927,323 A * 7/1999 Kikuchi et al. ..... 137/514.5
6,125,822 A * 10/2000 Janik ..... 123/514
6,209,527 B1 * 4/2001 Bueser et al. ..... 123/506
6,244,253 B1 * 6/2001 Haeberer et al. ..... 123/514

FOREIGN PATENT DOCUMENTS

JP 11-148442 6/1999

* cited by examiner

*Primary Examiner*—Thomas N. Moulis
(74) *Attorney, Agent, or Firm*—Nixon & Vanderhye P.C.

(57) ABSTRACT

A pressure limiter is connected fluid-tight between a common rail having an accumulator for storing high-pressure fuel delivered from a high-pressure fuel feed pump and a relief line. In a valve body of this pressure limiter, a damper chamber is provided on the downstream side of the sliding bore, for housing a large diameter portion of the piston and holding fuel, to thereby control the downward speed of the ball valve and the piston when the ball valve and the piston are shifted to the valve closing side by the force of the spring. Thus it becomes possible to prolong the downward-moving time of the ball valve and the piston.

8 Claims, 4 Drawing Sheets

ACCUMULATOR FUEL INJECTION APPARATUS FOR INTERNAL COMBUSTION ENGINES

CROSS-REFERENCE TO RELATED APPLICATION

The present invention is related to Japanese patent application No. 2000-220129, filed Jul. 21, 2000; the contents of which are incorporated herein by reference.

FIELD OF THE INVENTION

The present invention relates to an accumulator fuel injection apparatus for internal combustion engines, and more particularly, to an accumulator fuel injection apparatus for internal combustion engines provided with a pressure safety valve which is opened when an accumulator pressure has exceeded a preset value to thereby lower the accumulator pressure below the excess pressure.

DESCRIPTION OF RELATED ART

There has been generally known an accumulator fuel injection apparatus for internal combustion engines in which high-pressure fuel is pressurized and accumulated in an accumulator by means of a high-pressure feed pump. The high-pressure fuel thus accumulated in t he accumulator is distributed to a plurality of fuel injection valves installed in each cylinder of a vehicle-mounted internal combustion engine, then injected from the plurality of fuel injection valves into each cylinder of the internal combustion engine. The accumulator fuel injection apparatus for internal combustion engines is generally provided with a pressure safety valve in the end part of the accumulator.

The pressure safety valve, as shown in FIG. 4, operates to insure safety by preventing fuel leakage from each part in an emergency when an excessive quantity of high-pressure fuel is forced into the fuel supply line ranging from the high-pressure feed pump to the accumulator. FIG. 4A shows a behavior of the accumulator fuel pressure when the motor vehicle is driven to a turnout (a turnout being any diversion from a main road to a outside lane, turnout or other side-of-the road area) in an emergency, and FIG. 4B shows a behavior of the high-pressure fuel feed pump to be operated in case of an emergency driving to a turnout.

When the motor vehicle is driven from a driving or passing lane to a shoulder in an emergency driving in a turnout which requires excessive fuel to be supplied from the high-pressure fuel feed pump, the valve element of the pressure safety valve moves away from the valve seat to open the valve in a conventional fuel injection apparatus. In this case, however, the accumulator pressure is released, thereby lowering the pressure less than the excessive pressure and the operating pressure of the injector. Therefore, fuel injection from the injector into each cylinder of the internal combustion chamber will fail, causing the motor vehicle to be unable to drive to the turnout even when an emergency demands such.

For the purpose of solving the above-described problem of excessive pressure supply from the high-pressure fuel feed pump to drive the motor vehicle to a turnout in an emergency, there has been proposed such a device as disclosed in JP-A No. H4-72454, which produces a valve opening pressure required to prevent an accumulator pressure rise over a predetermined value and a valve closing pressure required to accomplish the emergency driving of the motor vehicle to the turnout.

In a conventional accumulator fuel injection apparatus for internal combustion engines, when an injection interval of the high-pressure fuel feed pump exceeds a predetermined interval, for example during the low-speed rotation of the internal combustion engine and the high-pressure fuel feed pump, the interval is relatively wide. During this interval, therefore, the accumulator pressure is likely to drop excessively low. Therefore the valve element of the pressure safety valve seats on the valve seat to close the valve. At this time, because the high-pressure fuel feed pump is in operation, the discharge pressure being discharged from the high-pressure fuel feed pump into the accumulator increases (the forced supply of excessive fuel remains unreleased at this point of time), and therefore the valve will open if the accumulator pressure increases again over the valve element opening pressure of the pressure safety valve, thus repeating the low-speed operation of the internal combustion engine.

Therefore, as shown in FIG. 4, the accumulator pressure varies as low as the value of the excessively lowered pressure below the valve opening pressure. It is, therefore, impossible to stabilize the accumulator pressure at a value (a regulated pressure) necessary for moving the motor vehicle in the event of emergency driving to a turnout. At this time the motor vehicle runs at a low speed such that noises and knocks occur, giving the driver (the user) discomfort.

SUMMARY OF THE INVENTION

It is therefore an object of the invention to provide an accumulator fuel injection apparatus for internal combustion engines implementing a pressure safety valve which allows smooth running of the motor vehicle to the turnout lane in an emergency by stabilizing the pressure necessary for emergency driving to the turnout to a low pressure at which no noise and knock will occur.

According to a first aspect of this invention, in an emergency where excessive pressure fuel is delivered from the high-pressure fuel feed pump, the accumulator pressure is increased by the excessive pressure of the high-pressure fuel feed pump. When the accumulator pressure has exceeded a predetermined value to overcome the spring force of the pressure safety valve, the valve element of the pressure safety valve and the piston rise off the valve seat of the valve body. Thus, the valve element opens the valve port of the valve body, releasing the abnormally high pressure which can cause fuel leaks, thereby enabling to insure safety against the abnormally high pressure.

To drive the motor vehicle to the turnout lane in an emergency as described above, the fuel pressure necessary for turning out the motor vehicle is increased higher than the fuel injection valve operating pressure to thereby enable fuel injection from the fuel injection valve to each cylinder, and also the pressure is decreased to a value at which no noise and knock will occur, to achieve driving stability. Then, on the downstream side of the sliding bore in the valve body of the pressure safety valve, a damper chamber is formed to house both the large-diameter portion of the pressure safety valve piston and the fuel, so that the downward speed of the valve element and piston, when displaced by the spring force toward the valve-closing side, is restrained, resulting in a prolonged time of downward movement of the valve element and the piston.

Therefore, if the internal combustion engine and the high-pressure fuel feed pump are operating at low speeds, the valve element can be held off the valve seat until the beginning of subsequent injection from the high-pressure fuel feed pump. The pressure for turning out the motor vehicle till the low-speed operation of the internal combustion engine and the high-pressure fuel feed pump can be kept at a controlled pressure. That is, the accumulator pressure can be kept at a low pressure at which neither noise nor knocks will occur. Therefore, the accumulator pressure can be stabilized at a pressure (regulated pressure) necessary for turning out the motor vehicle in case of an emergency without varying to an excessively low pressure below the valve opening pressure, thereby enabling smooth driving of the motor vehicle to a turnout lane in an emergency.

In another aspect, the damper chamber opens at the end face on the spring side of the valve body, being formed in a shape of recess having a larger inside diameter than the sliding bore. The damper chamber is defined by the end face on the sliding bore side of the large-diameter portion of the piston, the inner wall surface of the recess portion, and a stepped portion between the recess portion and the sliding bore.

In another aspect, the pump pressure for turning out the motor vehicle in an emergency because of excessive fuel delivery from the high-pressure fuel feed pump is determined by the outside diameter of the small-diameter portion of the piston and the spring force. It is, therefore, possible to easily set the pressure safety valve closing pressure for decreasing the accumulator pressure after releasing the pressure during an abnormally high pressure. Also, the pressure safety valve opening pressure is determined by the diameter of the valve element seat of the pressure safety valve and the set spring load, thereby enabling easy setting of the pressure safety valve opening pressure necessary for achieving safety.

In another aspect, between the outer peripheral surface of the small-diameter portion of the piston and the sliding bore of the valve body is formed a fuel passage for connecting the damper chamber to the valve hole when the valve element has moved upward over the predetermined value from the valve seat. For instance on the outer peripheral surface of the small-diameter portion of the piston is formed a cutout portion for forming the fuel passage therein, so that if the small-diameter portion of the piston is present within the sliding bore of the valve body when the valve element has risen over the predetermined value from the valve seat, the fuel can be released from the inside of the accumulator through the valve hole and the fuel passage.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DESCRIPTION OF THE PREFERRED EMBODIMENTS

Preferred embodiments of an accumulator fuel injector apparatus according to this invention will be described with reference to examples and the accompanying drawings.

Figure 1:
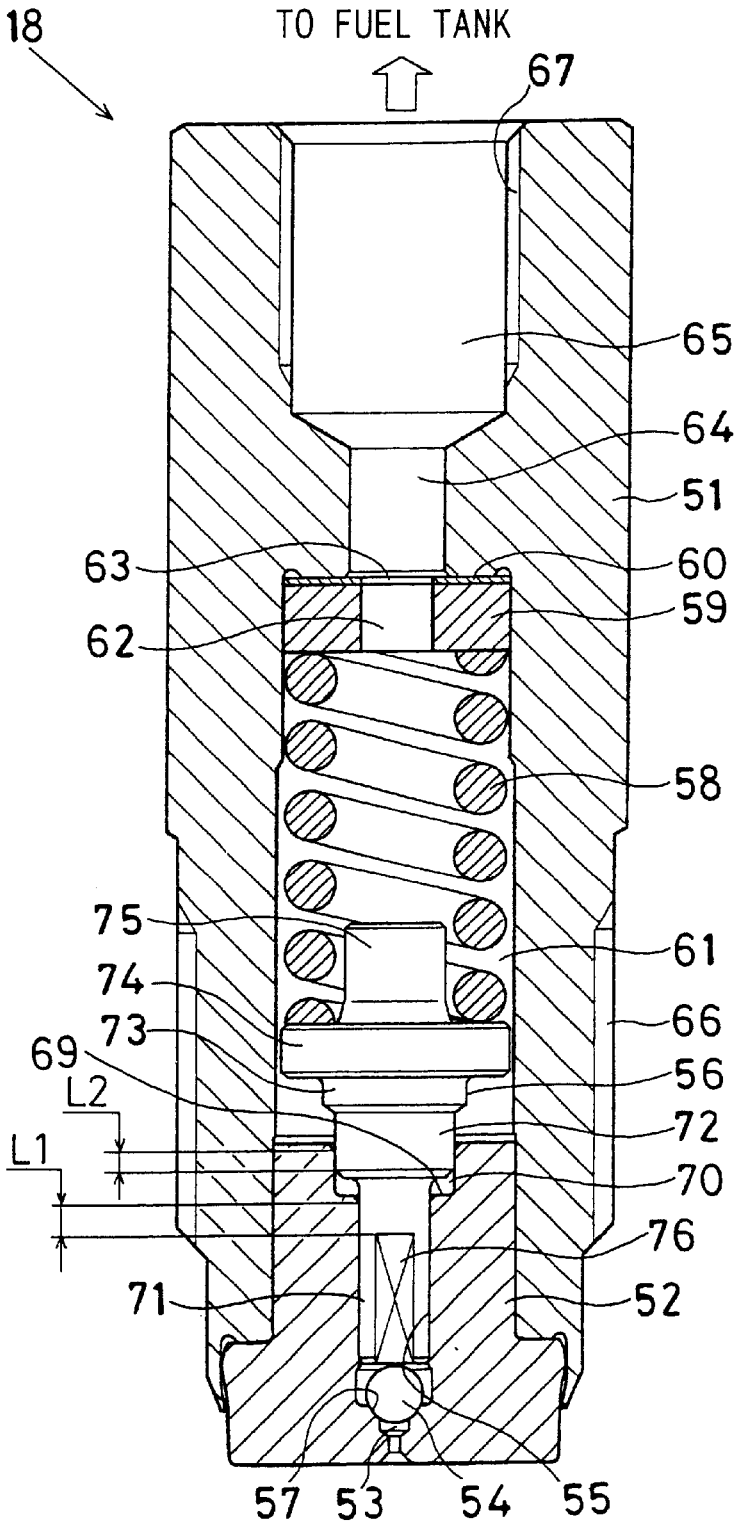
FIG. 1 is a cross-sectional view showing the structure of a pressure limiter according to the invention.
Figure 2:
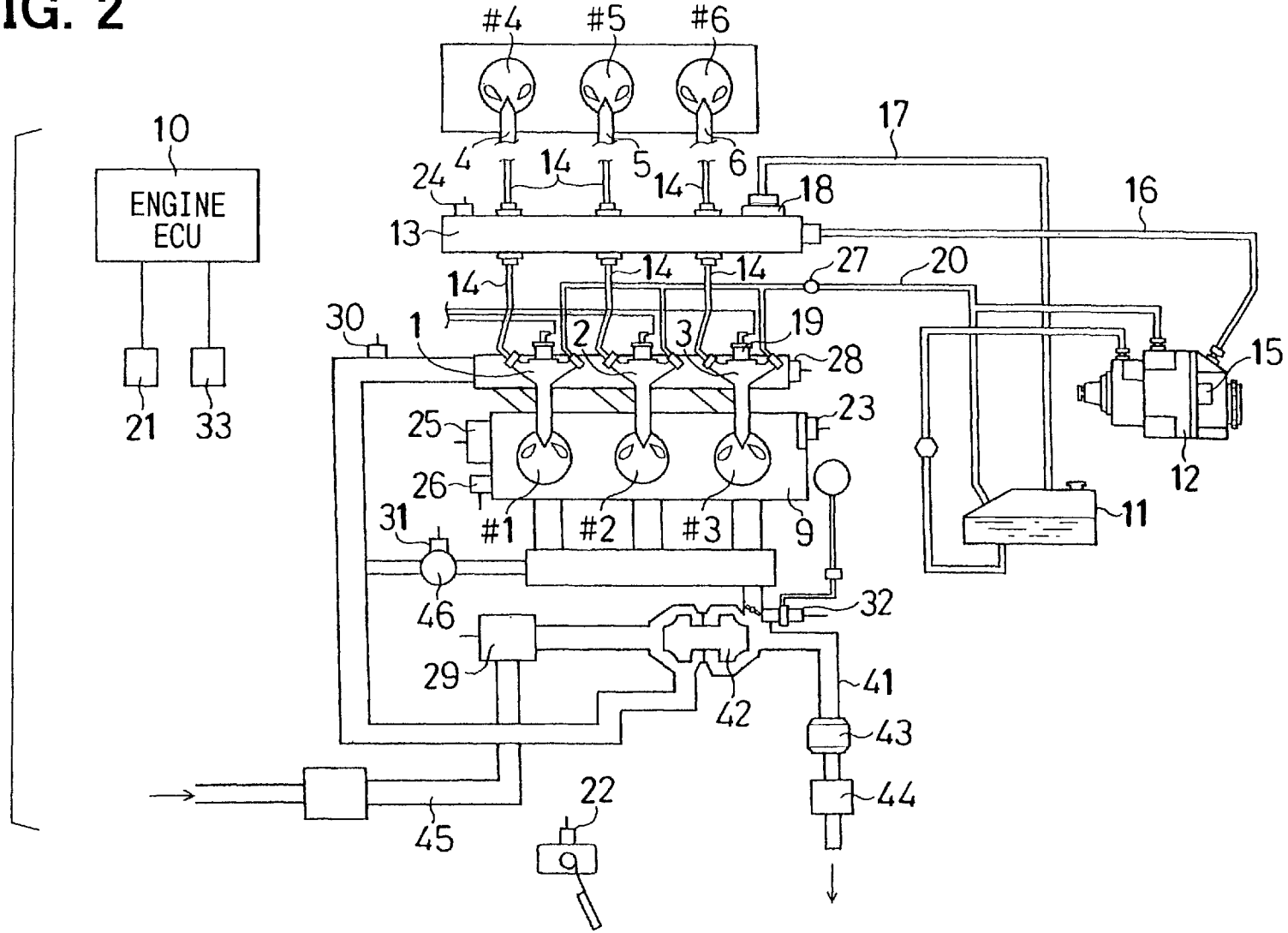
FIG. 2 is a schematic diagram showing the general structure of an accumulator fuel injection apparatus for diesel engines according to the invention.

FIGS. 1 to 3 show an example of this invention, of which FIG. 2 is a schematic diagram showing the general structure of an accumulator fuel injection apparatus for diesel engines.

The accumulator fuel injection apparatus for a diesel engine of this example is generally called a common rail system, which detects the operating condition of a six-cylinder diesel engine (an internal combustion engine hereinafter called only the engine) 9, the running condition of a motor vehicle such as a car, and the amount (intention) of operation of the driver by means of various sensors, to transmit information from these sensors to an electronic control unit (hereinafter called the engine ECU) 10, to compute the optimum amount of fuel to be injected and the fuel injection timing from this information, and to give a control command to actuators concerned.

In the fuel line of the accumulator fuel injection apparatus for diesel engines, a high-pressure fuel feed pump 12 is mounted which has a built-in feed pump for drawing fuel from a fuel tank 11 and pressurizes this fuel and delivers the fuel under a high pressure. A common rail 13 is also provided in the line that forms an accumulator inside. Also provided in the line is a plurality of fuel injection valves (hereinafter called the injectors) 1 to 6 connected to the common rail 13 through a high-pressure line 14 and attached by each cylinder of the engine 9. A regulating solenoid valve 15 functioning as an actuator mounted in the high-pressure fuel feed pump 12 is electronically controlled by a control signal from the engine ECU 10, regulating the amount of high-pressure fuel to be forced from the high-pressure fuel feed pump 12 to the common rail 12 through the fuel line 16, thereby changing the common rail pressure.

The plurality of injectors 1 to 6 are fuel injection nozzles installed for respective cylinders in the cylinder block of the engine 9 to inject the high-pressure fuel into each of combustion chambers No. 1 to No. 6 of the cylinders. The amount of fuel to be injected from the injectors 1 to 6 into the engine 9 and the fuel injection timing are determined by electronically controlling by the engine ECU 10 for energizing and de-energizing of the plurality of regulating solenoid valves 19 functioning as actuators. The common rail 13 is a kind of surge tank for holding the high-pressure fuel having relatively high pressure (the common rail pressure) and is connected to each of the injectors 1 to 6 through the high-pressure line 14 forming the fuel line. A relief line 17 for relieving the fuel from the common rail 13 to the fuel tank 11 is fitted with a pressure limiter 18 for relieving the pressure so that the accumulator pressure in the common rail will not exceed a limit accumulator pressure. In this example, the pressure limiter 18 is connected between the common rail 13 and the relief line 17.

The engine ECU 10 is provided inside with a microcomputer including a CPU which performs control processing and computation, RAM and ROM which store various kinds of programs and data, and a timer function. Signals fed from various sensors such as a vehicle speed sensor 21 for detecting the running speed of a motor vehicle, an accelerator opening sensor 22 for detecting the depth of depression of the accelerator pedal (the amount of accelerator opening), an engine coolant temperature sensor 23 for detecting the coolant temperature of the engine 9, and a fuel pressure sensor 24 for detecting the pressure of the high-pressure fuel accumulated in the common rail 13 are input to the microcomputer after A/D conversion by an A/D converter built in the engine ECU 10.

Other sensors are a crank angle sensor 25 mounted on the crankshaft of the engine 9 to produce a crank angle signal (an engine speed pulse signal), a cam angle sensor 26 mounted on the camshaft of the engine 9 to detect the angle of camshaft rotation and produce a cam angle signal, and a fuel temperature sensor 27 mounted on a return line 20 to detect the fuel temperature.

The microcomputer detects the engine speed by measuring the time interval between crank angle signals. In this case, intake air pressure sensor 28, intake air quantity sensor 29, intake air temperature sensor 30, EGR valve opening sensor 31, VNT driving quantity sensor 32, and shift position sensor 33 may be used. It is desirable that, for the purpose of improving detecting accuracy, the fuel temperature sensor 27 be mounted as close to a portion as possible at which the injectors 1 to 6 are connected to the return line. The engine ECU 10 functions, referring to the crank angle signal from the crank angle sensor 25 and the cam angle signal from the cam angle sensor 26, to determine the fuel injection timing (valve opening timing) of the injectors 1 to 6 and the fuel distribution period of the high-pressure fuel feed pump 12 to thereby control to hold the common rail pressure at a predetermined pressure value.

Subsequently, the quantity of fuel injection is computed with reference to the engine speed detected by the crank angle sensor 25 and the accelerator opening detected by the accelerator opening sensor 22, with the coolant temperature detected by the engine coolant temperature sensor 23 corrected. The injectors 1 to 6 are driven by an open-close command produced by computing the fuel pressure in the common rail 13 by each operating condition in order to attain the quantity of fuel injection thus computed, thereby operating engine 9. Exhaust gases generated by the combustion of fuel in the cylinder during operation of engine 9 flow through the exhaust pipe 41, being discharged through a catalyst 43 and a muffler 44 after driving a turbine of a variable nozzle turbocharger (VNT) 42. The control if the VNT 42 is performed in accordance with signals from the intake air pressure sensor 28 and the VNT driving quantity sensor 32.

The intake air supercharged by the VNT 42 is introduced into each cylinder of the engine 9 through the intake pipe 45, being mixed with exhaust gases coming from the exhaust pipe 41 while the opening of the EGR valve is controlled to a specific EGR quantity set by each operating condition to reduce exhaust emissions. The EGR quantity is feed-back controlled by the engine ECU 10 so that the predetermined EGR quantity may be achieved in accordance with signals from the intake air quantity sensor 29, intake air temperature sensor 30, and EGR opening sensor 31.

Next, the structure of the pressure limiter 18 of the present example will be briefly explained with reference to FIGS. 1 and 2. FIG. 1 is a view showing the structure of the pressure limiter 18. The pressure limiter 18 is equivalent to a pressure safety valve of this invention, comprising a housing 51 connected fluid-tight between the upper end portion of the common rail 13 and one end portion of the relief line 17, a valve body 52 secured on the forward end side of the housing 51, a ball valve (equivalent to the valve element of this invention) which opens and closes a valve hole 53 formed in the valve body 52, a piston 56 slidably supported in the sliding bore 55 formed in the valve body 52, and a spring 58 pressing by a predetermined force the ball valve 54 to a valve seat 57 through the piston 56.

The housing 51 is a cylindrical-shaped housing made of a metallic material, inside of which annular valve opening pressure adjusting shims 59 and 60 are fitted. In the housing 51 are formed an inlet-side fuel port 61, a small-diameter port 64, and an outlet-side fuel port 65. Inside the valve opening pressure adjusting shims 59 and 60 form fuel ports 62 and 63. On the outer periphery of the forward end side of the housing 51 is formed a male screw portion 66 which is in mesh with the mounting portion (not shown) of the common rail 13. Furthermore, on the inner periphery of the outlet-side fuel port 65 is formed a female screw portion 67 which is in mesh with the joint portion (not shown) of the relief line 17.

The valve body 52 is equivalent to the valve body of this invention, in the forward end portion of which is formed a valve hole 53 communicating with the accumulator of the common rail 13. Formed on the downstream side of the valve hole 53 is the valve seat 57 on which the ball valve 54 is seated to close the pressure limiter 18. Also on the valve hole side of the valve body 52 is formed a sliding bore 55 which slidably supports the piston 56; and on the spring side of the valve body 52 is formed a damper chamber 70 for prolonging the downward-moving time of the piston 56.

The piston 56 has a small-diameter portion 71 slidably supported in the sliding bore 55 from the forward end side toward the rear end side, a large-diameter portion 72 having a larger outside diameter than the small-diameter portion 71 and slidably supported in the damper chamber 70, a stepped portion 73 having a larger outside diameter than the larger-diameter portion 72, a flange portion 74 having a larger outside diameter than the stepped portion 73, and a stem portion 75 having a smaller outside diameter than the flange portion 74.

On the outer peripheral surface of the small-diameter portion 71 of the piston 56 is provided a cutout portion 76 between the outer peripheral surface and the sliding bore 55 of the valve body 52, thereby forming a fuel passage which is open to the damper chamber 70 and the valve bore 53 when the ball valve 54 and the piston 56 have moved up over a predetermined value (L1) from the valve seat 57. The cutout portion 76 is formed by machining flat a part of a round outer peripheral surface of the cylindrical small-diameter portion 71. The cutout portion 76, in the present example, is provided in two symmetrical positions.

The flange portion 74 of the piston 56 is provided with a fuel passage formed between the flange portion 74 and the inner peripheral surface of the inlet-side fuel hole 61 of the housing 51. The damper chamber 70 is a recess portion having a larger inside diameter than the sliding bore 55, opening in the end face (the rear end face) on the spring side of the valve body 52, and defined by the end face (the forward end face) on the sliding bore side of the large-diameter portion 72 of the piston 56, the recess-shaped inner wall surface of the valve body 52, and a stepped portion 69 between the recess portion of the valve body 52 and the sliding bore 55. The pressure limiter is so formed as to satisfy the relation L1>L2 when L1 is the length of overlap between the outer peripheral surface of the small-diameter portion 71 of the piston 56 and the inner peripheral surface of the sliding bore 55 and L2 is the length of overlap between the outer peripheral surface of the large-diameter portion 72 of the piston 56 and the inner peripheral surface of the damper chamber 70.

The spring 58 is equivalent to the spring of this invention, with one end being supported on the rear end face of the flange portion 74 of the piston 56 and with the other end being supported on the forward end face of the valve opening pressure adjusting shim 59. In the present example, the valve opening pressure of the pressure limiter 18 is determined by the seat diameter of the ball valve 54 and the set load of the spring 58. Furthermore, the pressure to be controlled, that is, the pressure required for forcing excessive fuel from the high-pressure fuel feed pump in case of emergency exit of the motor vehicle to a turnout, is determined by the outside diameter of the small-diameter portion 71 of the piston 56 and the force of the spring 58.

Features of Examples

Figures 3A, 3B:
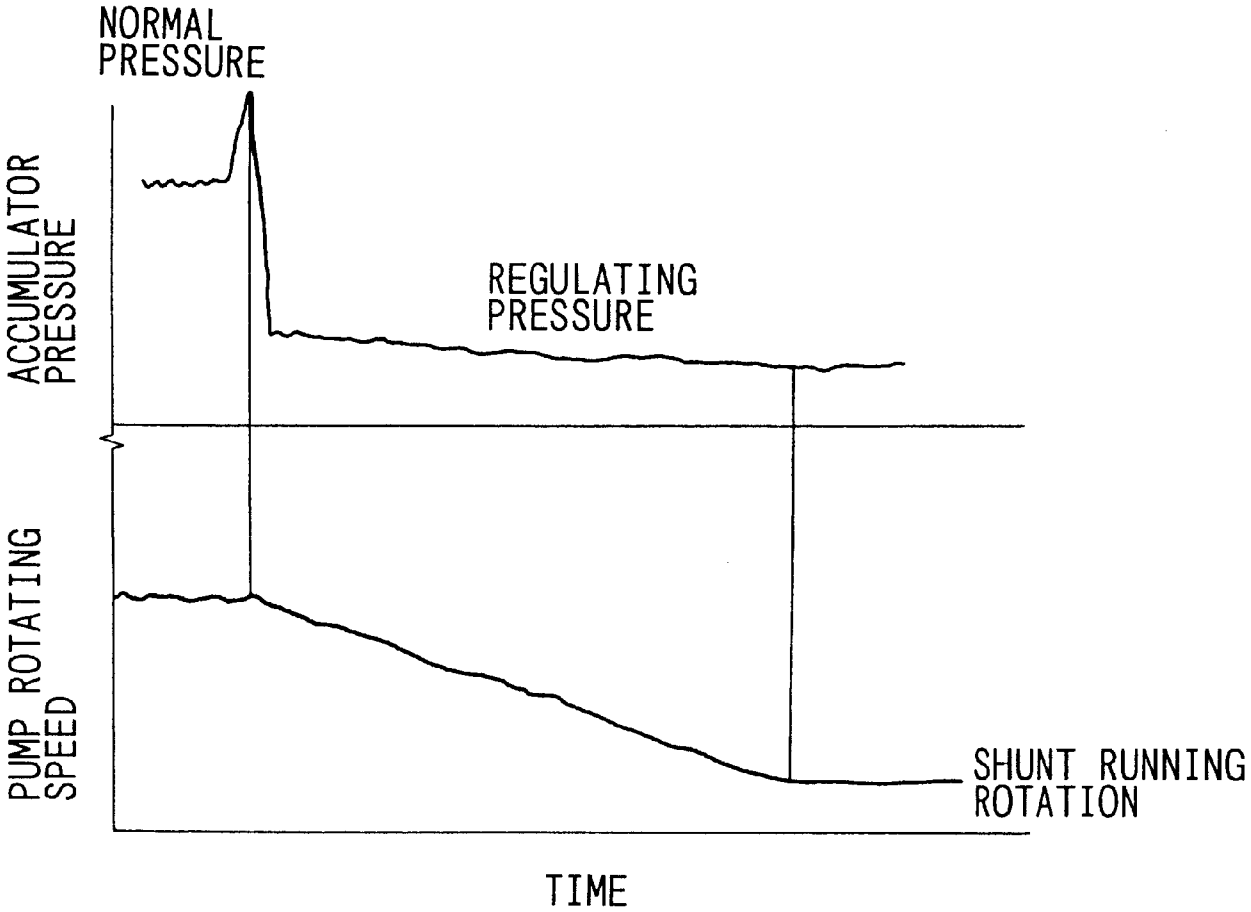
FIG. 3A is a time chart showing the behavior of an accumulator pressure during emergency exit from a main road to a turnout.
FIG. 3B is a time chart showing the behavior of the high-pressure fuel feed pump speed during emergency exit from a road to a turnout.
Figures 4A, 4B:
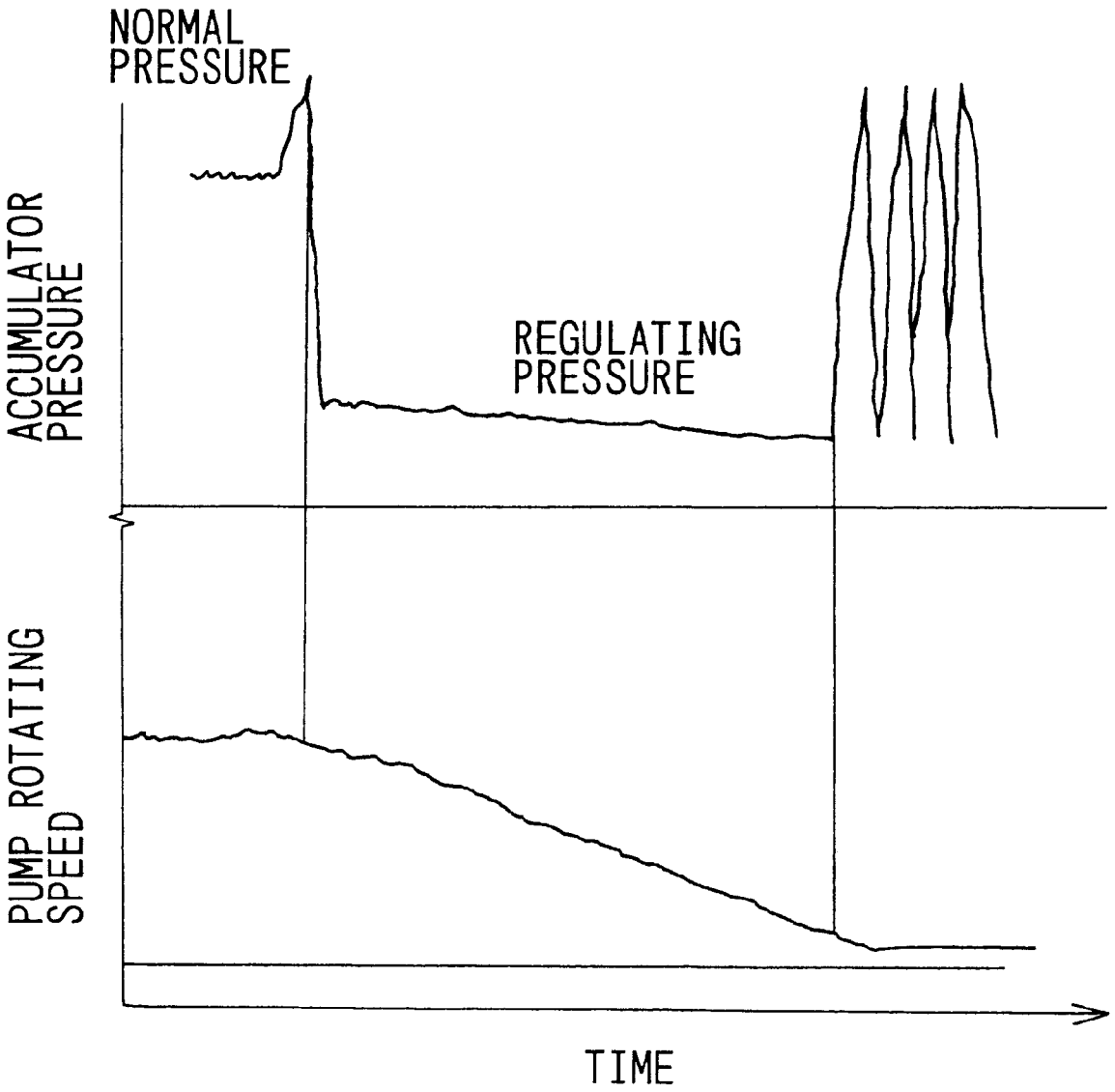
FIG. 4A PRIOR ART
FIG. 4B PRIOR ART
FIG. 4A is a time chart showing the behavior of the accumulator pressure during emergency exit from a road to a turnout according to the prior art.
FIG. 4B is a time chart showing the behavior of the high-pressure fuel feed pump speed during emergency exit from a road to a turnout according to the prior art.

Next, features of the pressure limiter 18 of the present example will be briefly explained with reference to FIGS. 1 to 3. FIG. 3A is a view showing the behavior of the accumulator pressure in case of emergency exit, and FIG. 3B is a view showing the behavior of high-pressure fuel feed pump speed in case of emergency evacuation.

When the high-pressure fuel feed pump 12 is normally operating, the accumulator pressure in the common rail 13 is kept at a higher normal pressure than the operating pressure of the injectors 1 to 6. The speed of the high-pressure fuel feed pump 12 is kept at a vehicle operable speed parallel to the speed of the engine 9.

In an emergency, when excessive fuel supply from the high-pressure fuel feed pump 12 is demanded, the accumulator pressure in the common rail 13 increases with the supply of excessive fuel from the high-pressure fuel feed pump 12. When the accumulator pressure exceeds the predetermined value (the set valve opening pressure), the force of the spring 58 is overcome, allowing the ball valve 54 and the piston 56 to rise from the valve seat 57 to open the ball valve 54. The valve lifts at this time a little more than the length of overlap Ll between the outer peripheral surface of the small-diameter portion 71 of the piston 56 and the inner peripheral surface of the sliding bore 55, thereby allowing the abnormally high pressure to escape from inside the accumulator of the common rail 13. Thus, the abnormally high pressure which will cause fuel leakage from each part is released, maintaining safety even during abnormal pressure.

To drive the motor vehicle to a turnout for emergency exiting as described above, it is necessary to increase the pressure to bring the motor vehicle to the turnout over the fuel injection valve operating pressure, to thereby permit fuel injection into each cylinder from the fuel injection valve and to secure stabilized driving condition at a low pressure at which neither noise nor knocking will occur.

This pressure, when used as a regulating pressure, is determined by the outside diameter of the large-diameter portion 72 of the piston 56 and the force of the spring 58. That is, the valve closing pressure is restricted with the square of the seat diameter of the ball valve 54 which determines the piston 56 and the valve opening pressure. The valve opening pressure with a dynamic effect (in the operating condition, the higher the flow velocity, the higher the valve closing pressure) taken into account is a regulating pressure.

Because of the presence of the damper chamber 70 defined by the recess portion of the valve body 52 and the large-diameter portion 72 of the piston 56, the downward speed of the ball valve 54 and the piston 56 when the ball valve 54 and the piston 56 are shifted to the valve closing side by the force of the spring 58 is slowed down, resulting in a prolonged downward-moving time of the ball valve 54 and the piston 56.

Therefore, the ball valve 54 can be held from seating on the valve seat 57 until the commencement of subsequent fuel injection from the high-pressure fuel feed pump 12 even when the engine 9 and the high-pressure fuel feed pump 12 are operating at low speeds. As a result, as shown in FIG. 3, the pressure, or the accumulator pressure, necessary for driving the motor vehicle to a turnout until the engine 9 and the high-pressure fuel feed pump 12 start low-speed operation can be maintained at a low regulating pressure at which no noise and knocks will occur. Therefore, the accumulator pressure will not vary to a pressure which has been excessively lowered below the valve opening pressure. It is possible to stabilize the accumulator pressure at a pressure value (the regulated pressure) necessary for driving the motor vehicle for emergency evacuation to a turnout. Therefore the motor vehicle can be smoothly driven to the turnout in an emergency, that is, when the high-pressure fuel feed pump 12 is demanded to deliver an excessive amount of fuel.

In this case also, when the engine 9 and the high-pressure fuel feed pump 12 are operating at very low speeds, no damping effect will work to restrain the downward speed of the ball valve 54 and the piston 56; and therefore the ball valve 54 is allowed to be seated on the valve seat 57 to close the valve, resulting in a varied valve opening pressure. To prevent this, the accumulator pressure may be monitored to raise the speeds of the engine 9 and the high-pressure fuel feed pump 12 to a speed at which the motor vehicle can be driven to a turnout. Thus, it is possible to provide a pressure limiter 18 which functions both to relieve the pressure and to drive to a turnout.

Modification

In the present example, an accumulator fuel injection apparatus for diesel engines is explained in which the high-pressure fuel stored in the accumulator is distributed to a plurality of injectors (fuel injection valves) 1 to 6 installed in each cylinder of the engine 9, and is fed from the plurality of injectors into each cylinder of the engine 9. It should be noticed that this invention may be applied to an accumulator fuel injection apparatus for diesel engines which injects the high-pressure fuel into the cylinders of the engine 9 from one fuel injection valve. In this case, a high-pressure line may be connected in place of the common rail between the high-pressure fuel feed pump 12 and the injector to form an accumulator in the high-pressure line.

In the present example has been explained a distributor-type fuel injection pump, as the high-pressure fuel feed pump 12, which has one or at least two pairs of plungers for distributing the fuel successively to each cylinder regardless of the number of engine cylinders. In this case also it is to be noted that an in-line fuel injection pump with a plurality of plungers corresponding to the number of engine cylinders may be used as the high-pressure fuel feed pump 12 to distribute the fuel to each plunger per turn of the camshaft.

Furthermore, in the present embodiment has been explained a six-cylinder diesel engine adopted as a multi-cylinder internal combustion engine. It is also to be noted that two-cylinder, four-cylinder, or at least eight-cylinder diesel engine may be used as the multi-cylinder internal combustion engine. Furthermore, at least two-cylinder gasoline engine may be adopted as the multi-cylinder internal combustion engine. In this case, the fuel injection valve is installed to the intake pipe located on the upstream side of the intake port of the cylinder.

In the present example, the ball valve 54 and the piston 56 are separately formed. The valve element and the piston may be integrally formed as one component. Furthermore, in the present example, the housing 51 and the valve body 52 are separately formed, but may be integrally formed as one component. Furthermore, in the present example, the spring 58 is adopted to press the ball valve 54 to the valve closing side through the piston 56; in this case, however, such springs (resilient members) as air cushion, cushion rubber, plate spring, etc. may be used to press the ball valve to the valve closing side through the piston 56.

While the above-described embodiments refer to examples of usage of the present invention, it is understood that the present invention may be applied to other usage, modifications and variations of the same, and is not limited to the disclosure provided herein.

What is claimed is:

1. An accumulator fuel injection apparatus for an internal combustion engine having an accumulator for storing high-pressure fuel delivered from a high-pressure fuel feed pump, and additionally, a pressure safety valve that opens when accumulator pressure has exceeded a predetermined value to lower the accumulator pressure below an excessive pressure, the pressure safety valve comprising:

a valve body having a valve hole, the valve body having a sliding bore formed on a downstream side of the valve hole;

a valve element axially movably positioned in the valve body to open and close the valve hole;

a piston having a small-diameter portion axially slidably supported in the sliding bore on a valve element side by the valve body, the piston having a large diameter portion which has a larger outside diameter than the small-diameter portion on an opposite side of the valve element, the piston being engaged with the valve element to axially move as one body together with the valve element;

a spring for pressing the valve element through the piston with a predetermined force in a direction toward closing the valve hole; and a damper chamber located downstream of the sliding bore in the valve body and housing the large diameter portion of the piston together with fuel;

wherein the damper chamber is a recessed portion of the value body of having a larger inside diameter than the sliding bore, having an opening in an end face on the spring side of the valve body, and being defined by the end face of the large diameter portion of the piston on the sliding bore side, an inner wall surface of the recessed portion and a stepped portion between the recessed portion and the sliding bore;

wherein the large diameter portion of the piston and the recessed portion of the valve body are disposed so that the large diameter portion of the piston exits the recessed portion of the valve body when the piston moves beyond a predetermined value.

2. An accumulator fuel injection apparatus for an internal combustion engine as in claim 1, wherein:

a pressure at which the high-pressure fuel feed pump delivers excessive fuel to drive the motor vehicle to a turnout in case of emergency is determined by the outside diameter of the small-diameter portion of the piston and the force of the spring.

3. An accumulator fuel injection apparatus for an internal combustion engine as in claim 1, wherein:

the valve opening pressure of the pressure safety valve is determined by the seat diameter of the valve element and the set load of the spring.

4. An accumulator fuel injection apparatus for an internal combustion engine as in claim 1, wherein:

a fuel passage is formed that communicates with the damper chamber and the valve hole when the valve element has moved upward from the valve seat over a predetermined value, said fuel passage being between an outer peripheral surface of the small-diameter portion of the piston and the sliding bore of the valve body.

5. A vehicle comprising:

an accumulator for storing fuel delivered from a fuel feed pump;

at least one fuel injection valve mounted in an internal combustion engine cylinder;

a pressure valve with a first end fluidly communicating with the accumulator and a second end fluidly communicating with a relief line to provide a fluid passage from the accumulator to a fuel tank, the pressure valve further including:

a valve body having in a first end a valve hole, the valve body having a sliding bore with a greater cross section than the valve hole, the valve body having a third bore, the valve body having a through passage, the third bore having a greater cross section than the sliding bore, the valve hole connecting the accumulator to the sliding bore, the through passage connecting the third bore to the relief line;

a piston having a first cross section portion slidably supported in the sliding bore, the piston having a large second cross sectional portion which has a larger outside diameter than the smaller first cross section portion, a valve element that moves with the piston as one body and is proximate the valve hole;

a spring biasing said piston to a first position;

wherein said piston and valve body are movable between the first position and a second position, wherein the valve element blocks fluid flow through the valve hole and at least a portion of said large cross sectional portion is surrounded by said large cross sectional bore in said first position; and wherein the valve element opens fluid flow through the valve hole and from the first end to the second end in the second position; and a damper chamber located downstream of the sliding bore in the valve body and housing the large diameter portion of the piston together with fuel, wherein the damper chamber is a recessed portion of the valve body having a larger inside diameter than the sliding bore, having an opening in the end face on the spring side of the valve body, and being defined by an end face of the large diameter portion of the piston on the sliding bore side, an inner wall surface of the recessed portion, and a stepped portion between the recessed portion and the sliding bore;

wherein the large diameter portion of the piston and the recessed portion of the valve body are disposed so that the large diameter portion of the piston exits the recessed portion of the valve body when the piston moves beyond a predetermined value.

6. A pressure valve, for supplying fuel from an accumulator to a relief line, said valve comprising:

a valve body having in the first end a valve hole, the valve body having a sliding bore with a greater cross section than the valve hole, the valve body having a third bore, the valve body having a through passage, the third bore having a greater cross section than the sliding bore, the valve hole connecting the accumulator to the sliding bore, the through passage connecting the third bore to the relief line; and a piston having a first cross section portion slidably supported in the sliding bore, the piston having a larger second cross sectional portion which has a larger outside diameter, a valve element that moves with the piston as one body and is proximate the valve hole; and a spring biasing said piston to a first position; and wherein said piston and valve body are movable between the first position and a second position, wherein the valve element blocks fluid flow through the valve hole and at least a portion of said large cross sectional portion is surrounded by said large cross sectional bore in said first position;

wherein the valve element opens fluid flow through the valve hole and from the first end to the second end in the second position;

a damper chamber located downstream of the sliding bore in the valve body and housing the large diameter portion of the piston together with fuel, wherein the damper chamber is a recessed portion of the valve body having a larger inside diameter than the sliding bore, an opening in the end face on the spring side of the valve body, and being defined by the end face of the large diameter portion of the piston on the sliding bore side, an inner wall surface of the recess portion, and a stepped portion between the recess portion and the sliding bore, wherein the large diameter portion of the piston and the recessed portion of the valve body are disposed so that the large diameter portion of the piston exits the recess portion of the valve body when the piston moves beyond a predetermined value.

7. An accumulator fuel injection apparatus for an internal combustion engine as in claim 4, wherein:

the fuel passage communicates with a valve hole and a damper chamber when the piston lifts beyond a first distance L1, a large diameter portion of the piston is disposed so as to exit the damper chamber when the piston lifts beyond a second distance L2, and a relationship where L1 is greater than L2, is maintained.

8. A pressure regulating valve for use with a fuel accumulator in a fuel injection system, said valve comprising:

a valve inlet port connected to a valve seat;

a valve outlet port; and an axially movable valve member disposed between said inlet and outlet ports and biased towards said valve seat to maintain said inlet port closed unless fluid pressure thereat exceeds a predetermined limit;

said valve member including a portion which engages a fluid damping chamber so as to damp valve member movement while the valve member is in a limited predetermined neighborhood of a closed inlet port position but which is otherwise fluidically disengaged from said damping chamber outside of said limited predetermined neighborhood;

wherein said damping chamber comprises a recess formed in a valve body that defines (a) an axially extending sliding bore in which a first piston portion of the valve member axially moves to close and open the inlet port, and (b) a downstream recessed damping chamber portion having a diameter larger than said sliding bore;

said valve member including a second piston portion of a diameter larger than that of the first piston portion and disposed downstream of the first piston portion;

said downstream second piston portion being disposed to enter said downstream recessed damping chamber when the valve member is within a distance L2 from closure of the inlet port;

said first piston portion including a less restricted fluid passage which communicates with the recessed damping chamber when the valve member is more than a distance L1 from closure of the inlet port; and L1 being greater than L2.

* * * * *